United States Patent [19]

Kirschner et al.

[11] Patent Number: 4,964,532

[45] **Date of Patent: * Oct. 23, 1990**

[54] OPEN TOP TANK HAVING A REMOVABLE AND SEALABLE LID WITH A FLOW RATE CONTROL DEVICE SUPPORTED THEREIN

[75] Inventors: Jonathan Kirschner, Marietta; William J. Saunders, Stone Mountain, both of Ga.

[73] Assignee: The Coca-Cola Company, Atlanta, Ga.

[ * ] Notice: The portion of the term of this patent subsequent to Jun. 14, 2005 has been disclaimed.

[21] Appl. No.: 775,994

[22] Filed: Sep. 13, 1985

Related U.S. Application Data

[63] Continuation-in-part of Ser. No. 738,432, May 28, 1985, abandoned.

[51] Int. Cl.[5] ..... B67D 3/00

[52] U.S. Cl. ..... 222/1; 222/211; 222/481.5; 222/129.1

[58] Field of Search ..... 222/481, 481.5, 482, 222/479, 211, 1

[56] References Cited

U.S. PATENT DOCUMENTS

| | | | |
|---|---|---|---|
| 1,607,610 | 11/1926 | Eckstein et al. . | |
| 2,589,622 | 3/1952 | McCabe | 222/481.5 |
| 2,708,056 | 5/1955 | Reid | 222/481 |
| 2,708,533 | 5/1955 | Nicholas | 222/481.5 X |
| 2,959,328 | 11/1960 | Palmer | 222/481 X |
| 3,108,718 | 10/1963 | Seener . | |
| 3,258,166 | 6/1966 | Kuckens . | |
| 3,807,607 | 4/1974 | Kuckens . | |
| 4,109,829 | 8/1978 | Kuckens et al. | 222/442 X |
| 4,121,507 | 10/1978 | Kuckens | 222/129.1 X |
| 4,293,081 | 10/1981 | Kuckens | 222/211 X |
| 4,316,557 | 2/1982 | Benoun et al. | 222/129.1 |
| 4,522,319 | 6/1985 | Richter | 222/481.5 |

FOREIGN PATENT DOCUMENTS 1275829 10/1961 France .

*Primary Examiner*—Andres Kashnikow
*Assistant Examiner*—Gregory L. Huson

[57] ABSTRACT

A refillable syrup tank for use in a post-mix beverage dispenser including an openable top through which the tank may be refilled and a discharge end at the bottom. A flow rate control assembly is mounted within the tank and includes a flow rate control tube extending from the top of the tank to a position spaced from the discharge opening. A removable lid with a hermetic sealing device fits onto the top openable end of the tank and supports the flow-rate control tube in the tank. The tube is permanently secured to the lid, for removal from the tank therewith. The hermetic sealing is achieved either by a snap-fit between the lid and the tank or an O-ring seal.

14 Claims, 2 Drawing Sheets

OPEN TOP TANK HAVING A REMOVABLE AND SEALABLE LID WITH A FLOW RATE CONTROL DEVICE SUPPORTED THEREIN

BACKGROUND OF THE INVENTION

This application is a continuation-in-part of prior application Ser. No. 738,432, filed May 28, 1985, now abandoned.

The present invention relates to an open top tank having a removable and sealable lid, including a flow rate control device therein for regulating the flow rate of liquid dispensed through a discharge opening thereof. More specifically, the present invention relates to an open top syrup supply tank for a post-mix beverage dispenser system having a removable lid and means therein for controlling the rate of flow of syrup dispensed to a mixing station in the dispenser system.

Heretofore, many types of syrup supply packages, containers or tanks for post-mix beverage dispenser systems have been developed which include flow rate control tubes within the tank for providing an even and steady flow of syrup to mixing stations in post-mix beverage dispensers. Exemplary of such a package or container is that described in U.S. Pat. 4,216,885 to Sedam, issued Aug. 12, 1980, and assigned to the same assignee as the present invention. In the Sedam syrup package, a flow rate control tube 18 is provided in a container 12. Flow rate control tube 18 has an open end 18A disposed a predetermined distance above a discharge opening formed in the container neck and an openable sealed end 18B extending through the bottom 22A of the container. When the openable sealed end 18B is opened, atmospheric pressure is established through tube 18, all the way to the point of the position of open end 18A, creating a hydrostatic pressure head which controls the rate of flow of syrup out of the container. In operation within a post-mix beverage dispenser system, the plastic bottle or syrup package of Sedam is inverted and inserted into a valve mechanism socket of the dispenser against a sharp piercing device. The piercing device ruptures a membrane 22B, extending across the open end of the syrup package to form a dispensing outlet therein. The sealed end of the tube 18B is then ruptured to permit the flow of air through the tube and, therefore, establishes atmospheric pressure at the open end 18A of the tube above the discharge opening. A pressure balance is then created within the bottle as the syrup is withdrawn and replaced by air, and from this point on, the tube 18 in the bottle functions to control the rate of flow of syrup to a substantially constant rate as the syrup is dispensed from the bottle.

Other examples of the use of flow rate control tubes in syrup packages can be found in U.S. Pat. 3,258,166 to Kuckens, issued June 28, 1966; U.S. Pat. 3,991,217 to Kuckens, issued Nov. 19, 1976; and U.S. Pat. 3,807,607 to Kuckens, issued Apr. 30, 1974.

The above patents to Sedam and Kuckens are quite effective in controlling the flow rate of syrup from a container. However, in each of the above syrup containers, the bottom (or top of the container once it becomes inverted) is closed, and venting to the atmosphere by the flow rate control tube is through the closed bottom. Because of this closed bottom, these containers must be filled through the discharge opening preparatory to use or loading in the post-mix beverage dispenser system. While this procedure is satisfactory for mass loading in a factory, it may be more cumbersome than desired for refilling containers on site at post-mix beverage dispenser locations.

Accordingly, a need in the art exists for a syrup container or tank which may be readily refilled from the top (or the end of the container opposite the discharge opening) rather than through the discharge opening.

SUMMARY OF THE INVENTION

Accordingly, it is a primary object of the present invention to provide a syrup tank for a post-mix beverage dispenser system of the gravity flow type, which has an open top through which it may be refilled and a removable and sealable lid for sealing the open top and supporting a flow rate control tube therein to provide a constant discharge rate of syrup therefrom.

The objects of the present invention are fulfilled by providing an apparatus for dispensing liquids with a controlled rate of flow comprising: a container with a top end openable to the atmosphere, a bottom end with a discharge opening therein and sidewalls connecting said top and bottom ends; a flow rate control tube having a top open end adjacent the top end of said container and a bottom open end disposed at a predetermined distance above said discharge opening, said tube establishing atmospheric pressure at said bottom open end thereof; and a removable lid having sealing means about the periphery thereof for engaging the openable top end of said container and means for supporting said flow rate control tube within the container.

The sealing means in a first embodiment is provided by a peripheral groove in the lid, which snap-fits onto a rim around the openable top end of the container.

In a second embodiment the sealing means is an O-ring disposed in a peripheral groove about a threaded lid which screws onto the openable sealed end of the container.

BRIEF DESCRIPTION OF THE DRAWINGS

The objects of the present invention and the attendant advantages thereof will become more readily apparent by reference to the accompanying drawings wherein.

DETAILED DESCRIPTION OF THE DRAWINGS

Figure 1:
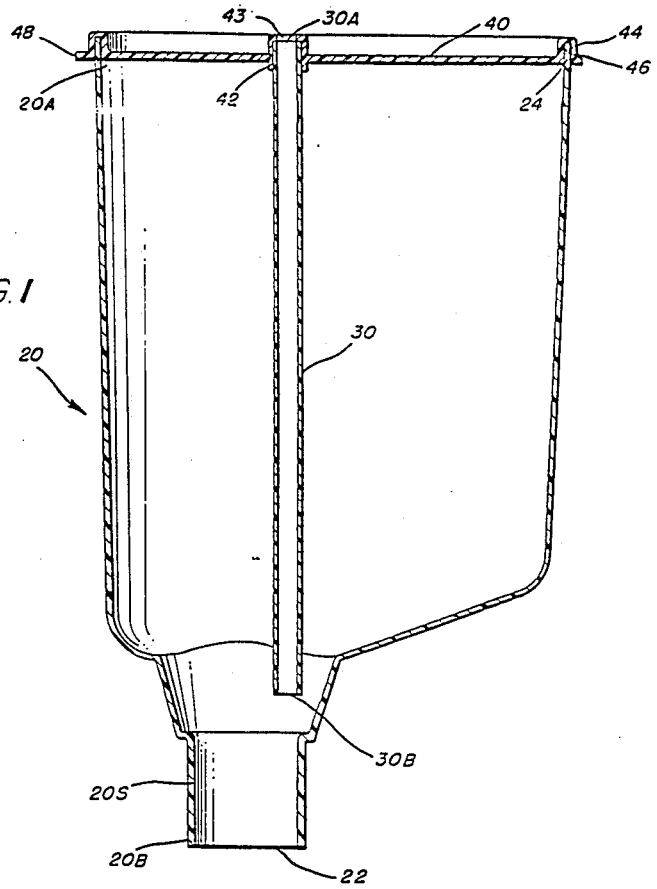
FIG. 1 is a cross-sectional view in side elevation showing a first embodiment of a syrup tank in accordance with the present invention with a removable, snap-fit lid supporting a flow rate control tube within the tank.
Figure 2:
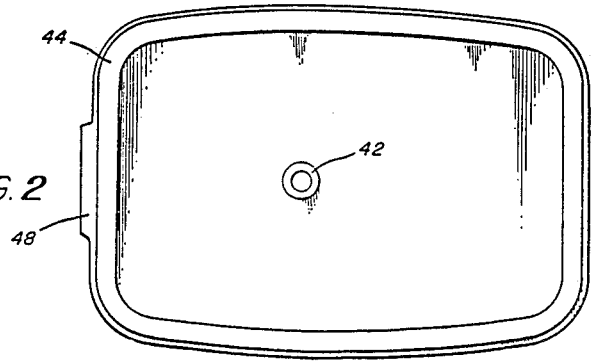
FIG. 2 is a top plan view of the removable snap-fit lid of FIG. 1.
Figure 3:
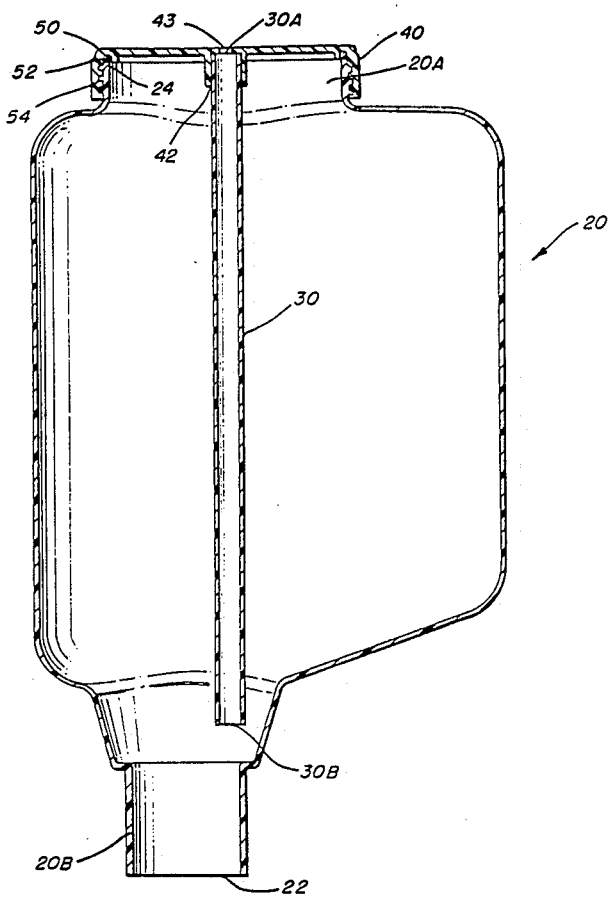
FIG. 3 is a second embodiment of a syrup tank utilizing a threaded lid with an O-ring seal.
Figure 4:
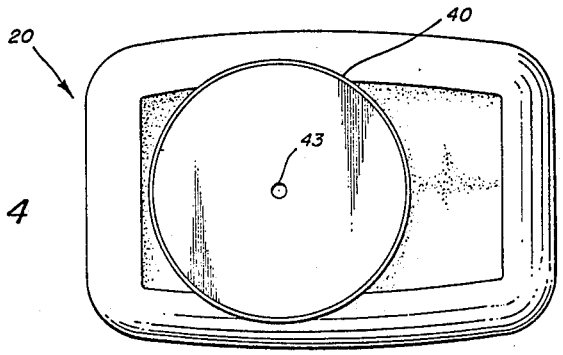
FIG. 4 is a top plan view of the lid of FIG. 3.

Referring to FIGS. 1 and 3, there is generally indicated a syrup tank 20 which may be plastic, metal or any other liquid-impervious material having an open top end 20A and an open bottom end 20B with a discharge spout 20S therein defining a discharge opening 22. Disposed within the syrup tank 20 is a flow rate control tube 30 having an open top end 30A and an open bottom end 30B.

Open end 30A of tube 30 is supported within a socket 42 in a removable lid 40. The end 30A of tube 30 is preferably permanently secured in socket 42 by heat sealing, ultrasonic welding, or by the use of suitable adhesives. Socket 42 has an aperture 43 which communicates with the atmosphere and the open end of tube 30A.

Removable lid 40 in the embodiment of FIG. 1 is provided with a peripheral shoulder 44 and a slot 46 which snap-fits over the peripheral rim 24 of the tank's open end 20A. Lid 40 is injection molded from a flexible plastic material, and the width of groove 46 therein is slightly less than the thickness of rim 24 to provide a snug, snap-fitting relationship. This assures the provision of a hermetic seal about rim 24 so that atmospheric pressure may be introduced into tank 20 only via aperture 43 and tube 30. Lid 40 also has a protrusion 48 extending from shoulder 44 to be gripped by an operator's fingers for removing the lid from tank 20, when the tank is to be refilled with syrup.

In the embodiment of FIG. 3, removable lid 40 is threaded as at 54, so that it may be screwed to a reduced diameter portion of tank 20 defining open top end 20A. A hermetic seal is provided in this embodiment by an O-ring 52 disposed in a peripheral groove 50 within removable lid 40. When screwed in place as shown in FIG. 3, O-ring 52 is compressed between rim 24 and lid 40 providing the desired hermetic seal.

In both embodiments of the present invention, the hermetic seal about rim 24 is essential to the proper operation of flow-rate control tube 30 because the leakage of air around rim 24 would cause the hydrostatic pressure head and pressure balance within tank 20 to fluctuate. Both the snap-fitting lid of FIG. 1 and the threaded lid and O-ring of FIG. 3 provide a satisfactory hermetic seal.

In both embodiments of the present invention, tube end 30B is supported at a predetermined position above discharge opening 22 by socket 42 in lid 40. By virtue of tube 30 and open end 30A being open to the atmosphere through aperture 43, atmospheric pressure is established in the liquid 32 just above the discharge opening 22. The creation of atmospheric pressure in the liquid 32 at open end 30B creates a pressure balance in the container which assures a substantially constant rate of flow of syrup through spout 20S and out of discharge opening 22.

When inserted into a post-mix beverage dispenser valving mechanism, such as that disclosed in U.S. Pat. 4,306,667 to Sedam et al., issued Dec. 22, 1981, spout 20S of tank 20 is disposed in the socket on the top of that valve mechanism and therefore the opening and closing of the valve mechanism initiates or terminates the flow of syrup out of tank 20.

The flow rate control tube 30 is preferably fabricated from a polyolefin, such as polyethylene, polypropylene or copolymers thereof.

The syrup tank 20 and lid 40 are preferably formed from Lexan®, high density polyethylene, PET (polyethylene terephthalate) or other moldable plastics. Of course, a metal tank could be used if desired.

It should be understood that the flow rate control mechanism of the present invention may be modified, as would occur to one of ordinary skill in the art without departing from the spirit and scope of the present invention.

What is claimed is:

1. A method for supplying syrup to a post-mix beverage dispenser at a controlled rate of flow comprising the steps of:

(a) providing a syrup tank including a container with a top end open to the atmosphere, a bottom end with a discharge opening therein and sidewalls connecting said top and bottom ends, said container having a rim around the top end defining a top opening;

(b) providing a flow rate control tube having a top open end adjacent the top opening of said container and a bottom open end disposed at a predetermined distance above said discharge opening, said tube establishing atmospheric pressure at said bottom open end thereof, and a removable lid of thin, flexible plastic having a sealing means for forming a hermetic seal between the lid and said rim around the top opening and a socket integrally formed with said removable lid for supporting said flow rate control tube within said container;

(c) connecting said discharge end of said container with a dispensing valve mechanism of said post-mix beverage dispenser;

(d) removing the lid from said tank;

(e) filling said tank with syrup through the top opening of said container;

(f) replacing the lid on said tank; and (g) actuating said dispenser valve mechanism to cause said syrup to be dispensed therethrough.

2. The method of claim 1, wherein said sealing means comprises a peripheral groove about said lid, the width of said groove being slightly less than the thickness of said rim to provide a snap-fit therewith.

3. The method of claim 1 wherein said sealing means comprises an O-ring gasket between said rim and said lid.

4. The method of claim 11 wherein said lid and container are threaded in the region of said rim to permit the lid to be screwed onto the container and wherein said sealing means comprises an O-ring gasket between the lid and the rim.

5. An apparatus for dispensing liquids with a controlled rate of flow comprising:

a container with an open top end, a bottom end with a discharge opening therein and sidewalls connecting said top and bottom ends, said container having a rim for defining said open top end;

a flow rate control tube having a top open end adjacent the open top end of said container and an open bottom end disposed at a predetermined distance directly above said discharge opening, said tube establishing atmospheric pressure at said open bottom end thereof; and a removable lid of thin, flexible plastic having sealing means for forming a hermetic seal between the lid and said rim defining said open top end, said lid being removable for refilling purposes; and means, provided in said removable lid, for supporting said flow rate control tube within said container wherein said means for supporting includes a socket integrally formed with said removable lid, for receiving and supporting the top open end of said flow rate control tube, said socket having an aperture therein for communication with the atmosphere and said top open end of said tube.

6. The apparatus of claim 5, wherein said sealing means comprises an O-ring gasket between said rim and said lid.

7. The apparatus of claim 5, wherein said lid and container are threaded in the region of said rim to permit the lid to be screwed onto the container and said sealing means comprises an O-ring gasket between the lid and the rim.

8. The apparatus of claim 5, wherein said sealing means comprises a peripheral groove about said lid, the width of said groove being slightly less than the thickness of said rim to provide a snap-fit therewith.

9. The apparatus of claim 8, wherein said removable lid further includes a protrusion extending from an edge of the lid which may be grasped by an operator's fingers for removing said lid from the container.

10. In a post-mix beverage dispenser, an apparatus for dispensing syrup at a controlled rate of flow comprising:

a container with an open top end, a bottom end with a discharge opening therein and sidewalls connecting said top and bottom ends, said container having a rim for defining said open top end;

a flow rate control tube having a top open end adjacent the open top end of said container and a bottom open end disposed at a predetermined distance directly above said discharge opening, said tube establishing atmospheric pressure at said bottom open end thereof; and a removable lid of thin, flexible plastic having sealing means for forming a hermetic seal between the lid and said rim defining said open top end, said lid being removable for refilling purposes; and means, provided in said removable lid, for supporting said flow rate control tube within said container wherein said means for supporting includes a socket integrally formed with said removable lid, for receiving and supporting the top open end of said flow rate control tube, said socket having an aperture therein for communication with the atmosphere and said top open end of said tube.

11. The apparatus of claim 10, wherein said sealing means comprises a peripheral groove about said lid, the width of said groove being slightly less than the thickness of said rim to provide a snap-fit therewith.

12. The apparatus of claim 11, wherein said removable lid further includes a protrusion extending from an edge of the lid which may be grasped by an operator's fingers for removing said lid from the container.

13. The apparatus of claim 10 wherein said sealing means comprises an O-ring gasket between said rim and said lid.

14. The apparatus of claim 13, wherein said lid and container are threaded int he region of said rim to permit the lid to be screwed onto the container and said sealing means comprises an O-ring gasket between the lid and the rim.

* * * * *